United States Patent [19]

van den Haak

[11] 4,394,842

[45] Jul. 26, 1983

[54] ANCHOR

[76] Inventor: Rob van den Haak, Allegro 114, Krimpen an der Ijssel, Netherlands

[21] Appl. No.: 209,368

[22] Filed: Nov. 24, 1980

Related U.S. Application Data

[63] Continuation of Ser. No. 973,239, Dec. 22, 1978, abandoned.

[30] Foreign Application Priority Data

Dec. 29, 1977 [BR] Brazil ..... 7708742
Jun. 30, 1978 [NL] Netherlands ..... 7807093

[51] Int. Cl.[3] ..... B63B 21/34
[52] U.S. Cl. ..... 114/304; 114/310
[58] Field of Search ..... 114/294, 301, 304, 306, 114/307, 309, 310

[56] References Cited

U.S. PATENT DOCUMENTS 957,621 5/1910 Neal ..... 114/306
2,354,666 8/1944 Danforth ..... 114/310 X
3,902,446 9/1975 van den Haak ..... 114/309
3,964,421 6/1976 van den Haak ..... 114/309
4,029,040 6/1977 Klaren ..... 114/304

*Primary Examiner*—Sherman D. Basinger
*Attorney, Agent, or Firm*—Louis E. Marn; Elliot M. Olstein

[57] ABSTRACT

An anchor having a twin fluke comprising closed hollow double-plate fluke structures, a shank hinged between the flukes substantially in the gravity center of the fluke, fluke angle delimiters on either side of the hinge, rear stabilizers at the side edges of the fluke, front stabilizers in the form of forwardly and outwardly diverging fluke finger tips, and wings connecting the fluke angle delimiters and each of the rear stabilizers, the wings diverge rearwardly and converge outwardly towards the rear stabilizers. In the preferred embodiment of the invention, the wings are located substantially rearwardly of the fluke with the rear stabilizers diverging rearwardly and inwardly to their intersection with the wings.

3 Claims, 6 Drawing Figures

FIG. 1
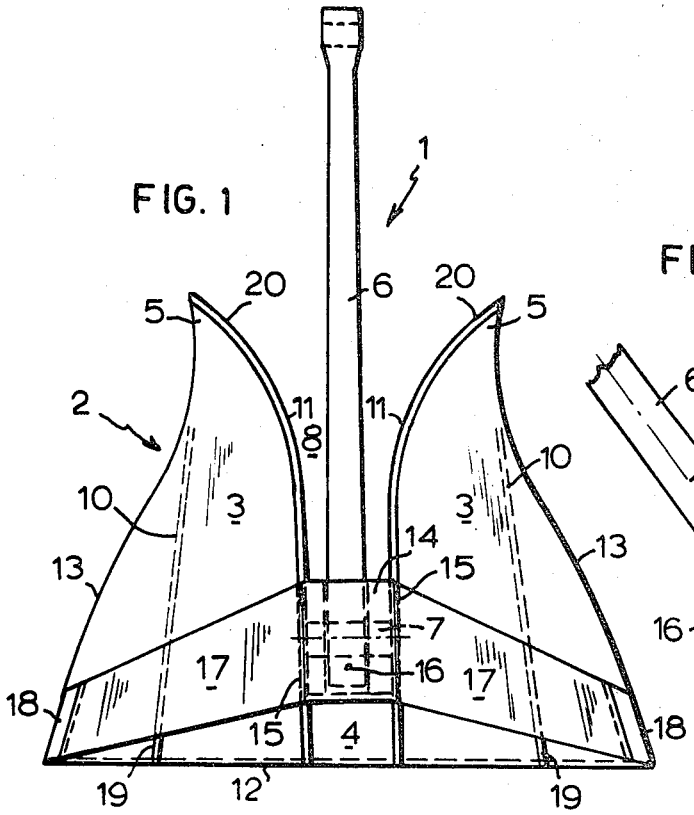
FIG. 3
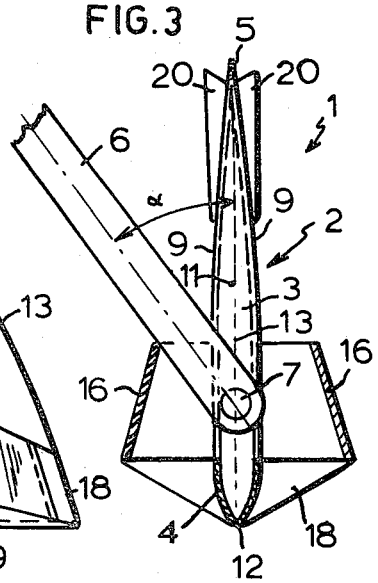
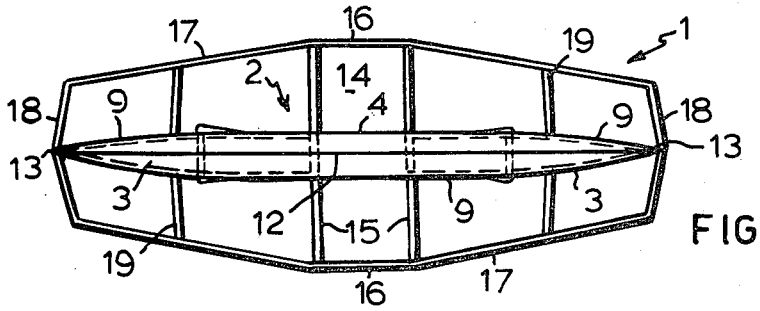
FIG. 2

FIG. 4
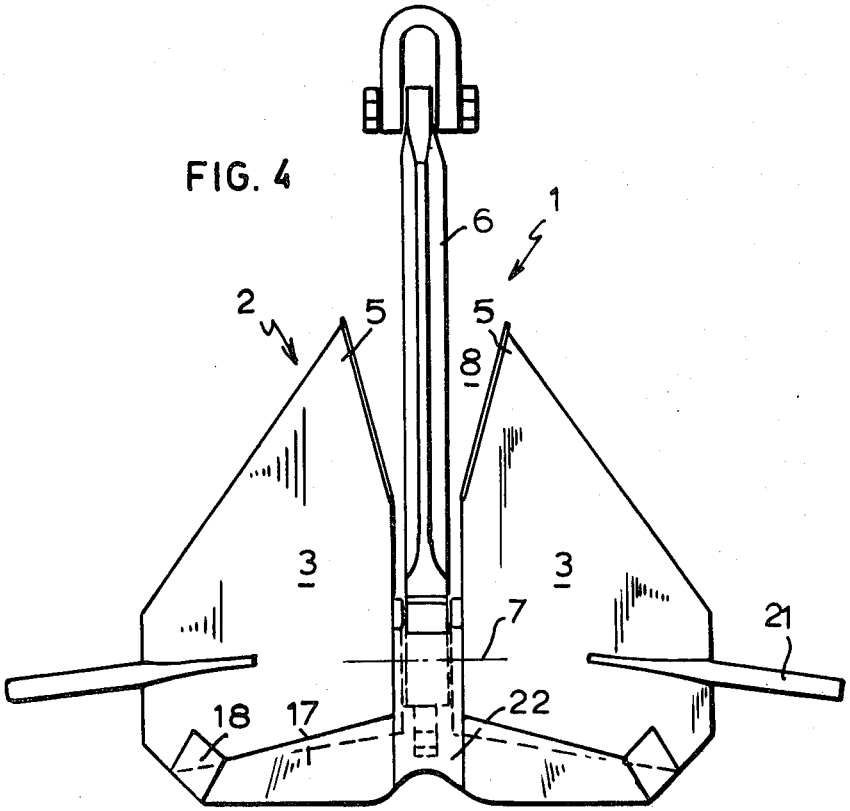
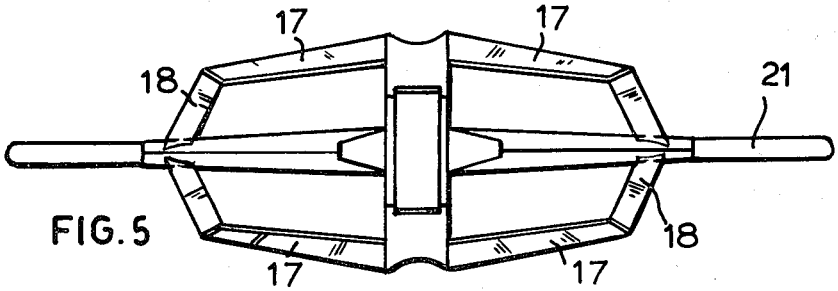
FIG. 5

ANCHOR

This is a continuation of application Ser. No. 973,239, filed Dec. 22, 1978 (now abandoned).

BACKGROUND OF THE INVENTION

This invention relates to an anchor comprising a two-handed fluke, a shank hinged to the fluke, and rear stabilizers. Prior anchors of this type have a fluke constructed of a single plate which is not capable to withstand high holding forces, and have rear stabilizers projecting laterally outside the fluke a substantial extent in order to provide sufficient stabilizing action.

SUMMARY OF THE INVENTION

It is an object of the invention to provide an anchor having a fluke of great strength with high holding power, but of relatively light weight, and of a high stability, i.e. resistance to lateral turning, provided by stabilizers which do not project laterally outside the fluke.

To achieve this object an anchor according to the present invention is characterized in that the fluke is a closed hollow structure defined by surface plates which are interconnected at their inner edges by flange plates and converge from said inner edges towards each other to form thin leading, trailing and side edges, the shank being mounted between the fluke hands on a hinge pin substantially in the gravity center of the complete fluke structure, head plates mounted on each side of the hinge to delimit the fluke angle, and wing plates diverging from said head plates to the rear stabilizers at the side corners of the fluke.

The fluke hands are each reinforced by internal ribs, and the wing plates have support plates on said ribs.

The reinforced double-walled fluke is much stronger than the prior single plate fluke so that the new anchor is more adapted to withstand heavy loads under high holding forces, and the winged rear stabilizers provide an improved stabilizing action and do not have to project laterally outside the fluke. The rear stabilizers are upstanding plates substantially within the side corners of the fluke.

To further augment the stability each fluke has an outwardly curved front tip on which upstanding forwardly pointed flanges are arranged to form front stabilizers. When digging-in the anchor outwardly directed force components are applied on the outwardly curved fluke tips so that a stabilizing i.e. anti-upturning moment is exerted.

Generally the fluke hands are interconnected by a transversely extending fluke portion rearwards of the hinge to form an integrated fluke structure of substantial rigidity.

A further embodiment of the here illustrated anchor is characterized in that the wings form a crown behind the fluke, with the wing plates diverging towards the sides to the fluke.

The purpose of the crown behind the fluke is to create an extension of the fluke surface with no additional weight, as the crown surface, once the anchor is in the correct inclined position, gives an additional dimension to the fluke surface because it lies outside the contour of the fluke, and the purpose of the diverging top plates of the fluke is to tilt the anchor also in the weakest soil with the tips of the fluke into the ground.

An anchor of this type can be completed by preferably dismountable stabilizing stocks for hard soil, which are situated laterally of the shank pin. In weak soil stabilizers in the form of stocks are superfluous as the side crown surfaces warrant sufficient stability, but in hard soil said stabilizing stocks are necessary as otherwise the anchor will slide on the side of the fluke along the ground. The here intended stocks extend only along a quarter of the fluke beam, thus not across the full beam of the anchor.

For tandem arrangement the here illustrated anchor has rearwardly a pad-eye which is protected by a pad-eye housing which is built-in centrally in the crown.

When comparing the newly presented anchor with a prior type anchor with a rearwardly arranged crown as described in U.S. Pat. No. 2,994,292 three important differences can be distinguished which offer as many advantages: firstly the hollow fluke structure of substantial depth is far superior in strength to the flat plate fluke structure in said patent; secondly the outwardly and forwardly diverging fluke finger tips which are now flanged on their diverging inner sides and not on parallel outer sides as in said patent are more apt to act as front stabilizers to guide the anchor in a straight line; and thirdly the top plates of the crown now have an essentially high depth where it is most required, on the fluke axis, to largely contribute to its greater strength, and contrary to what is stated in said patent it appears most advantageous to arrange the crown rearwardly outside of the contour of the fluke, and not within its shade, to enhance its surface area which most of all determines the holding power of the anchor. The here discussed known anchor is therefor to be constructed of expensive high tensile material to obtain a comparable high strength and holding power.

The superior strength and stability qualities of the herein discussed twin fluke anchor cannot be obtained with flat plate non-winged fluke structures as disclosed in U.S. Pat. Nos. 2,840,029 and 2,641,215 which have a rear stock instead of a rear crown.

The invention is described in more detail in the following specification with reference to the drawing, in which the invention is illustrated.

BRIEF DESCRIPTION OF THE DRAWING

FIG. 1 schematically shows an anchor having a two-handed double-walled fluke, winged rear stabilizers, and outwardly flared front stabilizers according to the present invention in plan view;

FIG. 2 is a rear view showing the well-supported winged rear stabilizers, in which view the reversely directed arrow-shaped front stabilizers on the outwardly flared fluke tips are also to be seen;

FIG. 3 is a longitudinal mid-section of the new type of anchor, with fluke and shank at the delimiting angle; and FIGS. 4, 5 and 6 show a further embodiment of the described anchor in plan view, rear view, and side view, respectively.

DESCRIPTION OF THE PREFERRED EMBODIMENTS

Figure 6:
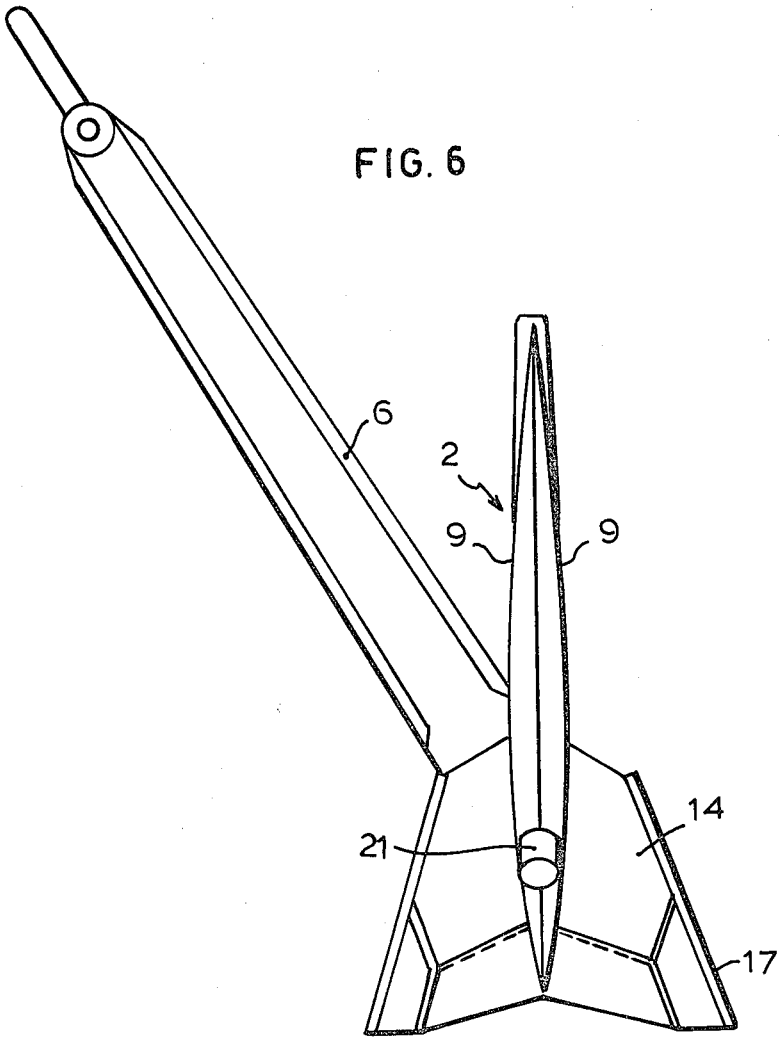

An anchor as generally represented in the drawings with reference numeral 1 has a fluke 2 comprising a pair of fluke hands 3,3 which are integrated by an interconnecting transversely extending rear portion 4 and which are each provided with at least one substantially forwardly directed finger tip 5, and pivotally connected to the fluke 2 is a shank 6 which is mounted on a hinge pin 7 in a slot 8 defined between the fluke hands 3,3 in the longitudinal axis of the anchor 1 and forwardly open and rearwardly closed by the transverse rear portion 4 of the fluke 2.

The fluke 2 is a hollow structure defined by surface plates 9,9 which are supported by internal ribs 10, and is closed on its periphery. The plates 9,9 converge sidewards, forwardly and rearwardly from truncated inner edges 11,11, respectively, and terminate in thin rear and side edges 12 and 13,13. The truncated inner edges 11,11 are defined by flange plates normal to the surface plates 9,9.

The hollow fluke structure 2 reinforced by internal ribs 10 is much stronger than a fluke consisting of a single solid plate and thus more adapted to bear heavy loads under high holding forces.

An important aspect of the anchor 1 is that the hinge pin 7 connecting the shank 6 to the fluke 2 is substantially located in the gravity center of the fluke structure is a hinge box 14 defined by side plates 15,15 and head plates 16,16.

Due to this location of its pivot the anchor 1 has a high self-burying capacity in any kind of anchorage ground, a high stability, i.e. resistance to lateral turning and, consequently, dragging of the anchor, and a high holding power but requires a low break-out force on the eye at the upper end of the shank as the shank will provide a high lever action.

In a thin layer of sand on a hard subsoil the short fluke length before the hinge point of the anchor and the fluke portion therebehind provide a (to 50%) higher holding power than, for example, a Danforth anchor of the same weight but having a much longer fluke length before the hinge point of the shank.

The large surface area behind the hinge point will grip the moved ground for a larger period of time, which results in a large holding power. Due to the short fluke length before the hinge, the shank may be far shorter than that of the Danforth anchor or other known anchors, which provides a substantial weight reduction.

The head plates 16,16 are spaced from the fluke surfaces and have connected thereto wing plates 17,17 diverging to the rear stabilizers 18,18 at the side corners of the fluke hand 3,3.

The head plates 16,16 converge towards the front of the fluke and function to delimit the slewing angle $\alpha$ between the shank 6 and fluke 2.

The head plates 16,16, the shape and position of which provide minimal resistance to burying, automatically place the fluke in the proper dig-in position.

The wing plates 17,17 are supported between the hinge box 14 and the rear stabilizers by plate ribs 19,19 preferably on and in line with the internal fluke ribs 10,10. The wings 17,17 augment the stabilizing action of the rear stabilizers 18,18 and due to their rearwardly diverging shape and position contribute to a minimal resistance to burying.

The stability of the anchor 1 is further augmented by the finger tips 5,5 of the fluke 2, which are outwardly curved and have upstanding flange plates 20,20 thereon which are of a reversely directed arrow shape to enhance their stabilizing action, and outwardly directed force components are applied thereon when digging-in the anchor so that an anti-upturning moment is created.

In FIGS. 4–6 an anchor construction is shown having a crown 17,17 situated behind the fluke 2, which gives an additional dimension to the fluke surface, and being further provided with preferably dismountable stocks 21,21 which are arranged laterally to the flukes 3,3 for anchoring in hard ground, and with a protecting housing 22 which is built-in centrally in the crown, for a pad-eye serving for tandem arrangement of a number of anchors.

Finally it is observed that the anchor as represented here is of course subject to variations and changes without departing from the scope of the invention.

What is claimed is:

1. An anchor comprising:

a fluke comprised of fluke hands of a reinforced closed hollow structure formed by upper and lower plates interconnected by inner edge plate members and converging towards each other to form thin leading, trailing and side edges, each of said fluke hands formed with an outwardly turned front tip portion;

a forwardly pointed flange member mounted normal to said fluke and on said outwardly turned front tip portion to enhance the stabilizing action of said anchor;

a hinge pin disposed at a point substantially coincident with the geometric center of gravity of said anchor;

a shank mounted to said fluke by said hinge pin;

a central box formed about said hinge pin and defined by upstanding plates and head plates to delimit fluke angle;

rear stabilizer elements mounted at side corners of each of said fluke hands; and wing plates extending from said head plates convergently towards said rear stabilizer elements and divergently towards said trailing edge.

2. The anchor as defined in claim 1 and further including a transversely extending fluke portion disposed rearward of said hinge and interconnecting said fluke hands.

3. The anchor as defined in claim 1 whereas said front tip portion is outwardly curved and said forwardly pointed flange member similarly curved with respect to said front tip portion.

* * * * *

UNITED STATES PATENT AND TRADEMARK OFFICE

CERTIFICATE OF CORRECTION

PATENT NO. : 4,394,842

DATED : JULY 26, 1983

INVENTOR(S) : ROB VAN DEN HAAK

It is certified that error appears in the above-identified patent and that said Letters Patent is hereby corrected as shown below:

On the title page add:

-- [73] Assignee: New Hook Anchors Holding (Jersey) Limited, Great Britain --.

Signed and Sealed this

*Twenty-sixth* Day of *June 1984*

[SEAL]

*Attest:*

GERALD J. MOSSINGHOFF

*Attesting Officer*

*Commissioner of Patents and Trademarks*